US010301885B2

(12) United States Patent
Farnes

(10) Patent No.: US 10,301,885 B2
(45) Date of Patent: May 28, 2019

(54) BEND STIFFENER

(71) Applicant: STATOIL PETROLEUM AS, Stavanger (NO)

(72) Inventor: Knut Aril Farnes, Trondheim (NO)

(73) Assignee: STATOIL PETROLEUM AS, Stavanger (NO)

( * ) Notice: Subject to any disclaimer, the term of this patent is extended or adjusted under 35 U.S.C. 154(b) by 302 days.

(21) Appl. No.: 15/036,619

(22) PCT Filed: Nov. 14, 2013

(86) PCT No.: PCT/EP2013/073810

§ 371 (c)(1),
(2) Date: May 13, 2016

(87) PCT Pub. No.: WO2015/070908

PCT Pub. Date: May 21, 2015

(65) Prior Publication Data

US 2016/0273278 A1 Sep. 22, 2016

(51) Int. Cl.
*E21B 17/01* (2006.01)

(52) U.S. Cl.
CPC ..... *E21B 17/017* (2013.01)

(58) Field of Classification Search
CPC ..... F21B 17/017; E21B 17/017
USPC ..... 138/106, 120, 36
See application file for complete search history.

(56) References Cited

U.S. PATENT DOCUMENTS 4,635,970 A 1/1987 Haines
6,422,791 B1 7/2002 Pallini, Jr. et al.
6,561,714 B1 5/2003 Williams et al.
7,568,861 B2 8/2009 Godoy et al.
8,007,434 B2 * 8/2011 Olson ..... A61B 1/00071 600/139
2007/0292214 A1 12/2007 Godoy et al.
2012/0048415 A1 * 3/2012 Espinasse ..... F16L 1/123 138/110
2012/0241037 A1 9/2012 Lund
2012/0304447 A1 * 12/2012 Smith ..... F16L 57/02 29/434
2015/0020910 A1 * 1/2015 Pedersen ..... E21B 17/017 138/106

FOREIGN PATENT DOCUMENTS

GB 2492109 A 12/2012
NO 20110419 A 9/2012
WO WO 2011/117567 A2 9/2011

* cited by examiner

*Primary Examiner* — Craig M Schneider
*Assistant Examiner* — David R Deal
(74) *Attorney, Agent, or Firm* — Birch, Stewart, Kolasch & Birch, LLP

(57) ABSTRACT

A bend stiffener 4 comprising a plurality of beams 5*a-g* arranged to be disposed around a tubular member 2. A support is provided for connecting the bend stiffener 4 to the tubular member 2. A first rigid rod 6*a* connects a first beam 5*b* of the plurality of beams to a second beam 5*c* of the plurality of beams. The first rigid rod 6*a* is connected at a surface of the first beam 5*b* such that it does not lie on the same axis as a second rigid rod 7*a* connected at an opposite surface of the first beam 5*a*. A stiffness of any of the plurality of beams and connectors between beams and rods provides bend stiffening to the tubular member 2.

14 Claims, 5 Drawing Sheets

BEND STIFFENER

TECHNICAL FIELD

The present invention relates to the field of bend stiffeners.

BACKGROUND

Risers and umbilicals are typically used in offshore hydrocarbon production to transport fluids (such as produced hydrocarbons or hydraulic fluids) between a well head at the sea bed and a surface vessel, for example a rig or a drill ship. Motion of the surface vessel caused by wind, waves, ocean currents and so on, leads to bending of the risers and umbilicals. This places periodic mechanical stresses on the risers and/or umbilicals, which can lead to mechanical failure.

The weakest point of each riser or umbilical is the point immediately adjacent to the connection to the surface vessel. This is the region subject to the highest mechanical stress, and therefore the region most likely to fail.

In order to strengthen the riser at this point, it is known to attach a bend stiffener 1 to the riser (the word riser is used herein to describe any pipe or umbilical extending from the surface vessel towards the well head or other subsea installation), as illustrated in FIG. 1. The bend stiffener 1 is disposed around a riser 2 that is connected at a riser connection point 3 to a surface vessel. This point is known as the "hang-off".

Existing bend stiffeners in use tend to be polyurethane stiffeners moulded into a truncated conical shape. Other types of material that have similar elastic properties to polyurethane may be used.

Conical bend stiffeners have an insulating effect around the riser, as they do not allow free movement of water. If the riser is carrying hot fluids, such as high temperature hydrocarbons, this insulating effect can give rise to high temperatures between the bend stiffener and the riser. Similarly, if an umbilical contains a high voltage power cable, this can give rise to heat. If the heat cannot dissipate away from the riser in the hang-off region, if may damage the riser or the bend stiffener. Heat is known to degrade polyurethane, so over time the bend stiffener and any polymeric outer sheath on the riser will become more prone to mechanical failure. This leads to a reduction in the lifetime of the outer sheath and the bend stiffener.

SUMMARY

It is an object to provide a bend stiffener that is less prone to thermally insulating the riser around the hang-off point.

According to a first aspect, there is provided a bend stiffener comprising a plurality of beams arranged to be disposed around a tubular member. A support is provided for connecting the bend stiffener to the tubular member. A first rigid rod connects a first beam of the plurality of beams to a second beam of the plurality of beams. The first rigid rod is connected at a surface of the first beam such that it does not lie on the same axis as a second rigid rod connected at an opposite surface of the first beam. A stiffness of any of the plurality of beams and connectors between beams and rods provides bend stiffening to the tubular member. An advantage of using beams and rods is that fluid such as seawater can pass between the bend stiffener and the tubular member, and the bend stiffener therefore does not thermally insulate the tubular member.

As an option, each beam is substantially flexible. This allows the stiffener to flex while still providing bend stiffening.

Each beam optionally comprises a flexible annular disc disposed such that the tubular member passes through an opening of the annular disc.

The annular disc optionally comprises a split thereby allowing it to be fitted to the tubular member. An advantage of this is that where the tubular member is a riser, the bend stiffener can be retro-fitted to an existing riser.

Each beam is optionally disposed in a plane substantially perpendicular to a main axis of the tubular member.

An elastic pad is optionally disposed at connectors between the beams and rods, the elastic pad providing bend stiffening to the tubular member.

A support is optionally connected to the first beam, the support having an attachment point for attaching to the tubular member. Alternatively, a support may be connected to the first rod, the support having an attachment point for attaching to the tubular member. As a further alternative, a support is connected to a connector connecting the first rod to the first beam, the support having an attachment point for attaching to the tubular member.

Each beam optionally has a selected stiffness according to its location along a main axis of the tubular member. In this way, the stiffness can be varied along the length of the bend stiffener. This allows, for example, a beam to have a higher stiffness in proximity with the hang-off point, compared to a beam remote from the hang-off point. The stiffness may be selected by varying any of a thickness of each beam and an elastic modulus of each beam.

According to a second aspect, there is provided a tubular member assembly comprising a tubular member and a bend stiffener as described above in the first aspect. Examples of tubular members include risers and umbilicals.

According to a third aspect, there is provided a method of fitting a bend stiffener to a tubular member. A plurality of beams is disposed around the tubular member. Each beam is connected using connectors to a first set of rigid rods, the first set of rigid rods being aligned along a first axis offset from but substantially parallel to a main axis of the tubular member. The rigid rods therefore do not form a contiguous path along the first axis. The bend stiffener is attached to the tubular member at the beams, the rigid rods and/or the connectors using supports.

DETAILED DESCRIPTION

Figure 1:
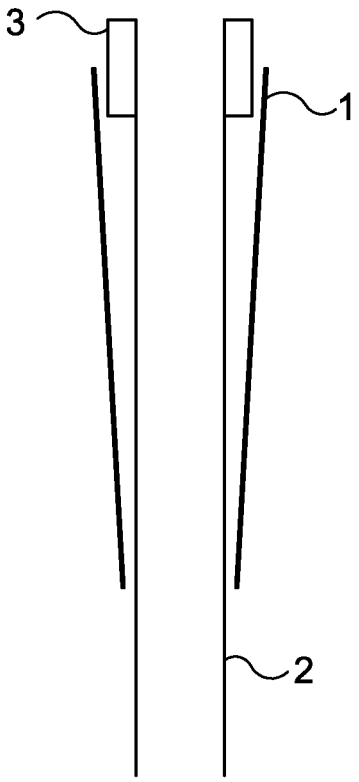
Figure 1 (prior art)
FIG. 1 illustrates schematically a cross-section view of a known bend stiffener and riser.
Figure 2:
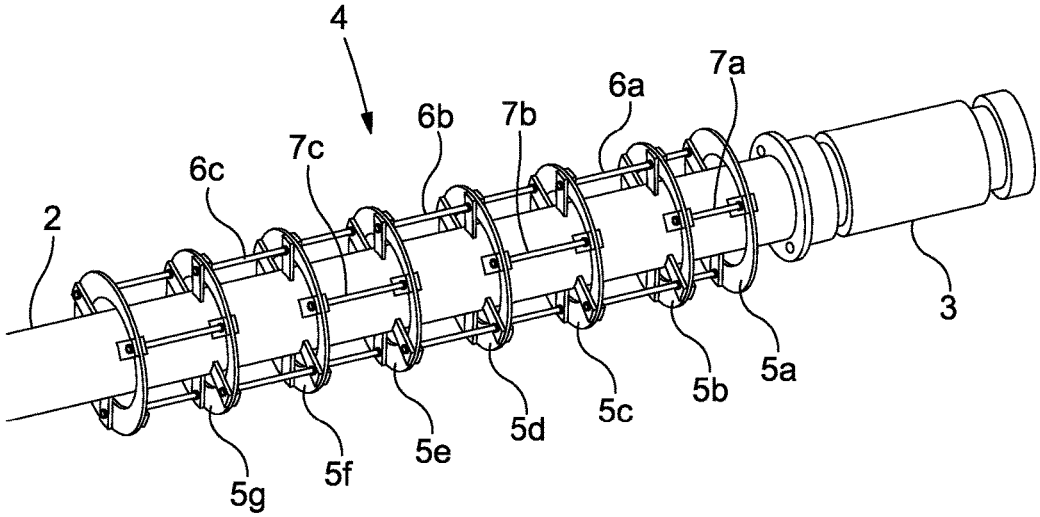
FIG. 2 is a perspective view of an exemplary bend stiffener.
Figure 3:
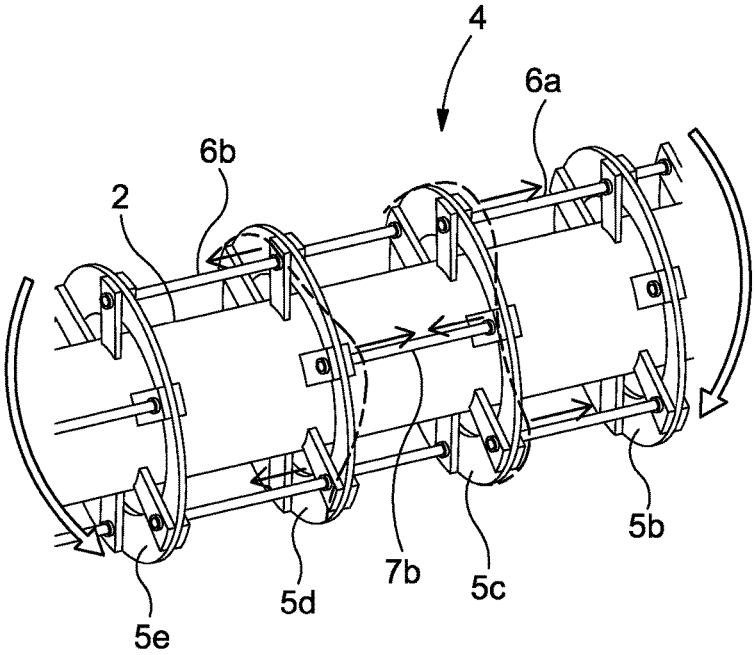
FIG. 3 is a perspective view of an exemplary bend stiffener showing bending.

FIGS. 2 and 3 show perspective views of an exemplary bend stiffener 4. The bend stiffener 4 surrounds a tubular member such as a riser 2 or other type of pipe or umbilical, and is disposed towards the hang-off point below the riser connection point 3.

The bend stiffener comprises a plurality of flexible annular discs 5*a-g*. Each annular disc is disposed around the riser 2 such that the riser 2 passes through the centre of each annular disc 5*a*-5*g*.

Several sets of rigid rods are provided to connect the flexible annular discs 5*a*-5*g*. In this example, two sets of rigid rods 6*a-c* and 7*a-c* are marked in FIG. 3. A first set of rigid rods 6*a-c* is disposed substantially along the same first axis, the first axis being substantially parallel to a main axis of the riser 2. However, the rigid rods on this axis are disposed such that they connect alternate annular discs. For example, the first rigid rod 6*a* of the first set of rigid rods connects annular disc 5*b* to annular disc 5*c*. The second rigid rod 6*b* of the first set of rigid rods connects annular disc 5*d* to annular disc 5*e*. The third rigid rod 6*c* of the first set of rigid rods connects annular disc 5*f* to annular disc 5*g*. Along the first axis, there are no rigid rods between annular disc 5*c* and annular disc 5*d*, or between annular disc 5*e* and annular disc 5*f*. This ensures that the first set of rigid rods 6*a-c* does not form a contiguous path along the first axis, and so the flexibility of the annular discs allows a degree of flexure in the bend stiffener.

Similarly, a second set of rigid rods 7*a-c* is disposed substantially along the same second axis, the second axis being offset from the first axis but also substantially parallel to the main axis of the riser 2. Again, the rigid rods of the second rigid rods are disposed such that they connect alternate annular discs. For example, the first rigid rod 7*a* of the second set of rigid rods connects annular disc 5*a* to annular disc 5*b*. The second rigid rod 7*b* of the second set of rigid rods connects annular disc 5*c* to annular disc 5*d*. The third rigid rod 7*c* of the second set of rigid rods connects annular disc 5*e* to annular disc 5*f*. Along the second axis, there are no rigid rods between annular disc 5*b* and annular disc 5*c*, or between annular disc 5*d* and annular disc 5*e*. This ensures that the second set of rigid rods 7*a-c* does not form a contiguous path along the second axis, and so the flexibility of the annular discs allows a degree of flexure in the bend stiffener.

The above description refers only to two axes, but it will be appreciated that any suitable number of axes may be used provided no axis comprises a contiguous path of rods. In the examples of FIGS. 2 and 3, there are six axes disposed around the riser 2 having non-contiguous rods connecting annular discs.

Note that each annular disc 5*a-g* may be provided with a split in it or as tow halves. The combination of the split and the flexibility of the annular discs 5*a-g* allows the bend stiffener to be retrofitted to an existing riser 2 without having to disconnect the riser at the hang-off point.

As shown by the dotted lines in FIG. 3, when a bending moment is placed on the bend stiffener 4, the elasticity of the flexible annular discs 5*a*-5*g* allows the bend stiffener to flex owing to flexure of the annular discs 5*a-g*. The required stiffness can be determined by using annular discs 5*a-g* with different stiffness. This may be achieved by selecting a material with the desired elastic modulus, and/or using an annular disc having a thickness that gives the required stiffness. Note that this can also be used to vary the amount of flexure allowed along the length of the bend stiffener. For example, the annular discs 5*a* and 5*b* located towards the hang-off point at the riser connection point 3 may have a higher stiffness than the annular discs 5*f*, 5*g* at the opposite end of the bend stiffener. This provides more stiffness at the hang-off point, and therefore provides a greater degree of protection to the riser 2 at the hang-of point where stress tends to be highest.

As the rods are rigid, they act only as spacers between the annular discs 5*a-g*, and do not significantly contribute to flexure of the bend stiffener 4. However, the rods provide an open structure and so water can pass directly over the riser 2. This ensures that any heat generated by hot fluids or electric cables can be dissipated, and the bend stiffener 4 does not act as a thermal barrier insulating the riser 2 towards the hang-off point.

Figure 4:
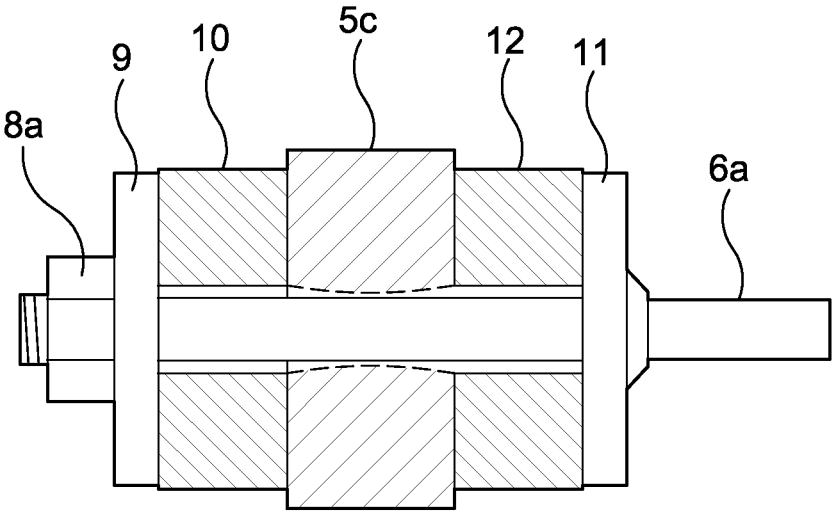
FIG. 4 illustrates schematically a cross-section view of an exemplary connector between a road and an annular disc.
Figure 5:
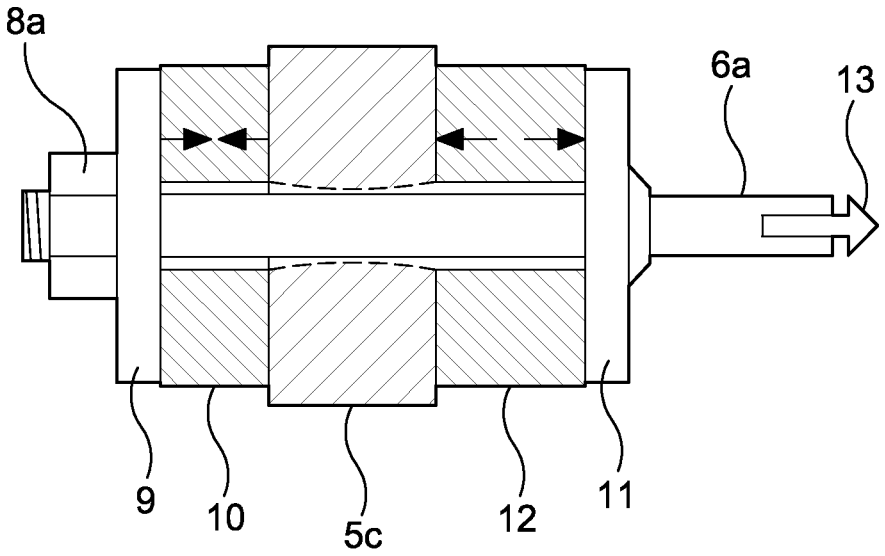
FIG. 5 illustrates schematically a cross-section view of an exemplary connector between a road and an annular disc under tension.

Note that a degree of flexibility can also be introduced by providing some flexibility at a connector between each rod and annular disc. FIGS. 4 and 5 illustrate an exemplary connector between a rod 6*a* and an annular disc. The rod 6*a* goes through the annular disc 5*c* and is secured by a threaded nut 8, although it will be appreciated that any type of connector may be used. A first washer 9 is disposed between the nut 8*a* and the annular disc 5*c* which holds a first elastic pad 10 between the first washer 9 and the annular disc 5*c*. A second washer 11 is disposed on the opposite side of the annular disc 5*c* to the first washer 10, and a second elastic pad 12 is disposed between the second washer 11 and the annular disc 5*c*.

FIG. 4 shows the connector when there is no bending of the bend stiffener 4. However, when the bend stiffener 4 flexes, the connector is also placed under stress. In the example of FIG. 5, the arrow 13 shows the direction of tension. In this case, the first elastic pad 10 is compressed and the second elastic pad 12 expands elastically. In this way, the elastic pads 10, 12 of the connector provide a degree of flexure in addition to the degree of flexure provided by the flexible annular discs 5*a-g*.

The thickness and/or elastic modulus of the elastic pads 10, 12 can be selected to provide different degrees of stiffness at different points of the bend stiffener 4.

Figure 6:
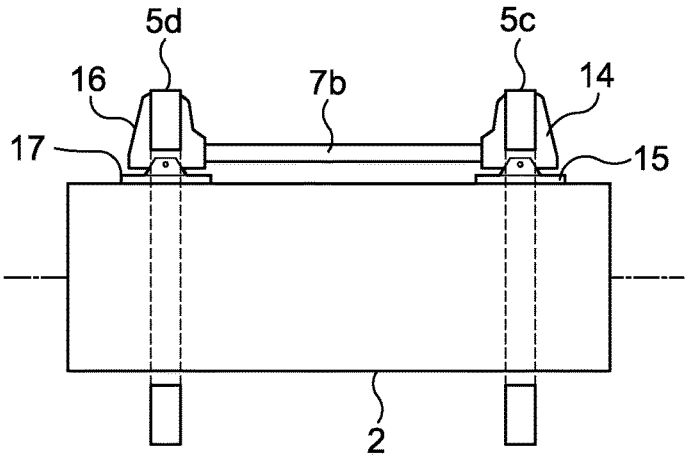
FIG. 6 illustrates schematically a side elevation view of a portion of a bend stiffener attached to a riser at a connection point.

There are various different ways in which the bend stiffener can be attached to the riser 2. FIG. 6 shows a first connector 14 attaching annular disc 5*c* to rod 7*b*. A first support 15 is used to attach the first connector 14 to the riser 2*b* any suitable means.

A second connector 16 attaches rod 7*b* to annular disc 5*d*, and a second support 17 attaches second connector 16 to the riser 2. In this way, the bend stiffener is attached to the riser using supports at the annular discs.

Figure 7:
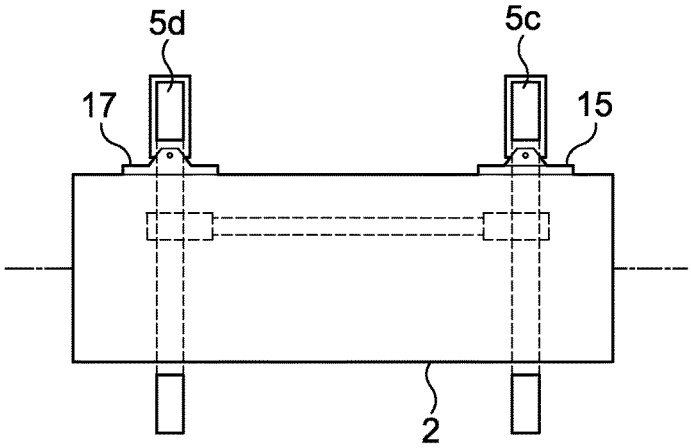
FIG. 7 illustrates schematically a side elevation view of a portion of a bend stiffener attached to a riser at an annular disc.

FIG. 7 shows first support 15 attaching annular disc 5*c* directly to the riser, and second support 17 attaching annular disc 5*d* directly to the riser.

Figure 8:
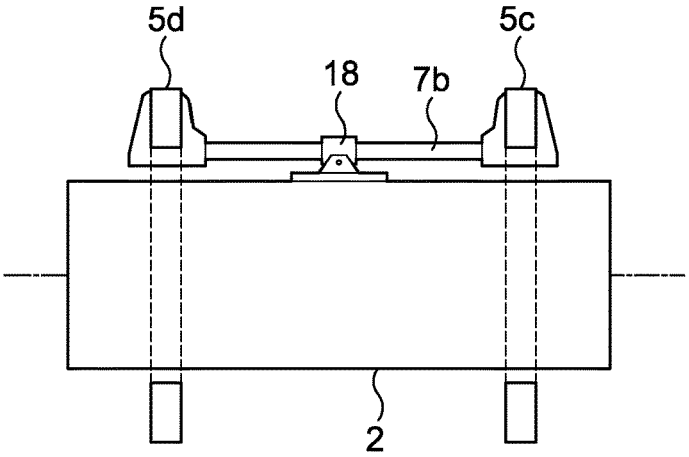
FIG. 8 illustrates schematically a side elevation view of a portion of a bend stiffener attached to a riser at a rigid rod.

FIG. 8 shows a support 18 attaching rigid rod 7*b* directly to the riser, such that the annular discs 5*c*, 5*d* do not directly contact the riser 2.

Figure 9:
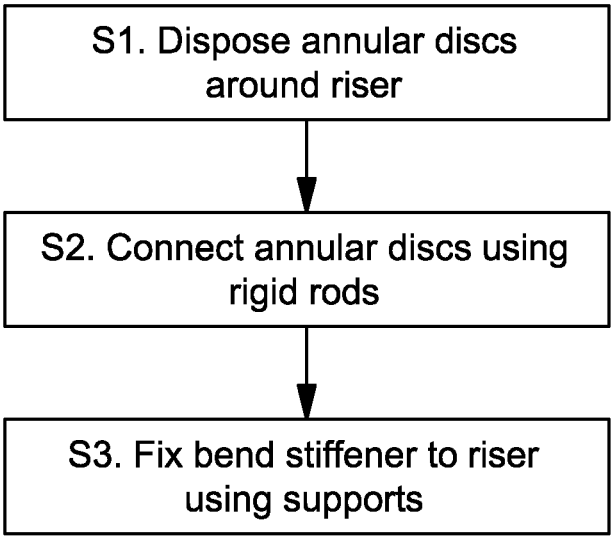
FIG. 9 is a flow diagram showing exemplary steps for fitting a bend stiffener to a tubular member.

FIG. 9 is a flow diagram showing exemplary steps for fitting a bend stiffener 4 to a riser 2. The following numbering corresponds to that of FIG. 9:

S1. Flexible annular discs 5*a-g* are disposed around the riser 2 towards the hang-off point. This may be before the riser 2 is fitted at the riser connection point 3, or by using split flexible annular discs that can be retrofitted to a riser that is already connected at the riser connection point 3.

S2. The annular discs 5*a-g* are connected together using sets of rigid rods 6*a-c*, 7*a-c* such that each set of rigid rods does not form a contiguous path along an axis substantially parallel to a main axis of the riser 2.

S3. The bend stiffener 4 is attached to the riser 2 using any suitable supports, either at the connectors as shown in FIG. 6, the annular discs as shown in FIG. 7, or the rods as shown in FIG. 8.

Note that the above steps may be carried out in any suitable order. For example, step S2 may be carried out first to assemble the entire bend stiffener 4 before it is fixed to the riser 2.

Note that the above description refers to annular discs providing stiffness but allowing some flexibility of the riser. This is a preferred embodiment, but it will be appreciated that any suitable beam may be used. For example, in the example of FIG. 3, annular disc 5*c* could be replaced by three beams, each beam connecting a pair of adjacent rods. Alternatively, each annular disc may be replaced by a pair of semicircular beams. Similarly, each annular disc may instead have a substantially hexagonal shape (in the example where six axes of rods running parallel to a main axis of the riser 2 are used). The skilled person will be able to develop other configurations.

Similarly, the annular discs 5*a-g* are shown as lying in a plane substantially perpendicular to the main axis of the riser 2. It will be appreciated that the discs may be inclined with respect to that plane. This can further stiffen the bend stiffener in particular directions.

The bend stiffener 4 describes above need not contain any mercury, unlike existing polyurethane bend stiffeners, and so is less harmful to the environment. Furthermore, the bend stiffener 4 does not provide thermal insulation to the riser 2, and so is less likely to cause thermal degradation of the bend stiffener 2 or any polymeric sheaths on the riser 1. As described above, it is possible to produce the annular discs 5*a-g* in semicircular halves or with splits to enable mounting or remounting the bend 4 stiffener with the riser connection point 3 of the riser 2 already connected.

It is described above that the degree of stiffening provided by the bend stiffener 4 can be varied along its length by using annular discs of different thickness/elasticity. The non-linear stiffening of the bend stiffener 4 allows designers to optimize the stiffness of the bend stiffener 4 for both extreme loads and fatigue loads on the riser 2.

It will be appreciated by the person of skill in the art that various modifications may be made to the above-described embodiments without departing from the scope of the present invention as described in the appended claims. For example, the embodiments above use the example of a riser 2, but the bend stiffener 4 can be used with any type of tubular member such as a riser or an umbilical.

The invention claimed is:

1. A bend stiffener comprising:

a plurality of beams arranged to be disposed around a tubular member;

a support for connecting the bend stiffener to the tubular member; and a first set of rigid rods being axially aligned on a first axis arranged to be offset from but parallel to a main longitudinal axis of the tubular member, wherein the first set of rigid rods do not form a contiguous path along the first axis, and each beam is connected using connectors to the first set of rigid rods, wherein each beam has a selected stiffness according to its location along the main longitudinal axis of the tubular member, and a beam in proximity to a hang-off point of the tubular member has a higher stiffness than a beam remote from the hang-off point.

2. The bend stiffener according to claim 1, wherein each beam is flexible.

3. The bend stiffener according to claim 1, wherein each beam comprises a flexible annular disc disposed such that the tubular member passes through an opening of the annular disc.

4. The bend stiffener according to claim 3, wherein the annular disc comprises a split thereby allowing it to be fitted to the tubular member.

5. The bend stiffener according to claim 1, wherein each beam is disposed in a plane perpendicular to the main longitudinal axis of the tubular member.

6. The bend stiffener according to claim 1, further comprising an elastic pad disposed at connectors between the beams and rods, the elastic pad providing bend stiffening to the tubular member.

7. The bend stiffener according to claim 1, wherein the support is connected to a first beam, and the support comprises an attachment point for attaching to the tubular member.

8. The bend stiffener according to claim 1, wherein the support is connected to a first rod, and the support comprises an attachment point for attaching to the tubular member.

9. The bend stiffener according to claim 1, wherein the support is connected to one of said connectors, said connector connecting a first rigid rod of the first set of rigid rods to a first beam of the plurality of beams, the support having an attachment point for attaching to the tubular member.

10. The bend stiffener according to claim 1, wherein the stiffness is selected by varying any of a thickness of each beam and an elastic modulus of each beam.

11. A tubular member assembly comprising:

a tubular member; and the bend stiffener according to claim 1.

12. The tubular member assembly according to claim 11, wherein the tubular member is any of a riser and an umbilical.

13. The bend stiffener according to claim 1, wherein the first set of rigid rods are connected to the plurality of beams in such a manner that along the first axis, there are no rigid rods out of the first set of rigid rods connecting every other two immediately adjacent beams, and wherein each of the rigid rods has two distal ends respectively connected to corresponding two beams, and is independent of one another.

14. A method of fitting a bend stiffener to a tubular member, the method comprising:

disposing a plurality of beams around the tubular member;

connecting each beam using connectors to a first set of rigid rods, the first set of rigid rods being axially aligned on a first axis arranged to be offset from but parallel to a main longitudinal axis of the tubular member, wherein the rigid rods do not form a contiguous path along the first axis; and attaching any of the beams, the rigid rods and the connectors to the tubular member using supports, wherein each beam has a selected stiffness according to its location along the main longitudinal axis of the tubular member, and a beam in proximity to a hang-off point of the tubular member has a higher stiffness than a beam remote from the hang-off point.

* * * * *